US008991318B2

(12) United States Patent
Wike et al.

(10) Patent No.: US 8,991,318 B2
(45) Date of Patent: Mar. 31, 2015

(54) STABILIZED RAILWAY FREIGHT CAR TRUCK

(71) Applicant: AMSTED Rail Company, Inc., Chicago, IL (US)

(72) Inventors: Paul Steven Wike, Saint Louis, MO (US); Aleynikov Igor Arkadyevich, Saint Louis, MO (US)

(73) Assignee: AMSTED Rail Company, Inc., Chicago, IL (US)

( * ) Notice: Subject to any disclaimer, the term of this patent is extended or adjusted under 35 U.S.C. 154(b) by 159 days.

(21) Appl. No.: 13/834,080

(22) Filed: Mar. 15, 2013

(65) Prior Publication Data

US 2014/0261064 A1 Sep. 18, 2014

(51) Int. Cl.
*B61F 5/52* (2006.01)

(52) U.S. Cl.
CPC ..... *B61F 5/52* (2013.01)
USPC ..... 105/198.4

(58) Field of Classification Search
CPC ..... B61F 5/122; B61F 5/32; B61F 5/26; B61F 5/12
USPC ..... 105/223, 198.4, 198.2, 225, 187, 208.1, 105/185, 193, 198
See application file for complete search history.

(56) References Cited

U.S. PATENT DOCUMENTS 1,823,884 A * 9/1931 Brittain, Jr. ..... 105/218.1
6,672,224 B2 * 1/2004 Weber et al. ..... 105/187

* cited by examiner

*Primary Examiner* — Mark Le
(74) *Attorney, Agent, or Firm* — Edward J. Brosius

(57) ABSTRACT

A stabilized railway car truck consists of two side frames and a holster. The bolster has laterally opposite ends, each end extending into and supported within a side frame opening on a spring group. The stabilized railway car truck also includes a transom extending into, and supported within, a side frame opening. The spring group is supported at each transom end. Each side frame has a pedestal opening at each end that receive a rotating lug to accept a elastomeric steering pad and bearing adapter. The attachment of the side frames and transom is a rigid pivotal connection. Friction shoes between the side frames and bolster provide damping of an initial low to a high rate friction once engaged. The pivotal decoupling of the side frame and transom, and the lateral movement of the friction shoes to the bolster, eliminates track displacement irregularities from reacting at the bolster and into the vehicle.

10 Claims, 6 Drawing Sheets

STABILIZED RAILWAY FREIGHT CAR TRUCK

BACKGROUND OF THE INVENTION

The traditional three piece railway freight truck consists of one bolster and two side frames that are configured to utilize friction shoes between the bolster and side frames as a means to provide damping of the suspension. The friction shoes additionally provide a limited means to keep the relationship of the side frames aligned squarely to the bolster and wheelsets. Lateral track displacement irregularities are transmitted to the wheelsets and into the side frames creating uneven lateral displacement of the side frames. The uneven displacement of the side frames exceeds the friction shoes' squaring capability, allowing the side frames to pivot or hinge about the friction shoes and bolster. The pivoting or hinging of the side frames yaws the wheelsets, creating misalignment to the railway track, which limits the stability of the traditional three piece freight truck.

The present invention relates to a stabilized railway freight car truck with a rigid transom, pivotally affixed between the side frames. The side frames are also pivotally affixed to the wheelsets. The pivotal relationship of the wheelsets to the side frames and the side frames to the transom allows lateral movement, which prevents the lateral track displacement irregularities from being transmitted to the bolster and into the vehicle. The pivotal but rigid connection between the side frames and transom eliminates yawing of the wheelsets thusly making the railway freight truck stable.

The stabilized railway freight car truck also has friction damping that initiates at low friction and changes to damping at higher friction once engaged. The damping is derived from friction shoes with a pivotal friction face in the form of friction shoe inserts that allow the friction force to react radially and pivotally.

The stabilized railway freight car truck bolster is supported on springs. The springs are supported on the transom which is pivotally supported on the side frames. The friction shoes, located between the bolster and side frames, further decouple lateral track displacement irregularity inputs transmitted to the wheelsets through the side frames by low friction inserts between the friction shoes and bolster. There is a space on either side of the friction shoes and bolster that allows lateral movement. The lateral movement of friction shoes along the space prevents transmission of lateral railway track displacement irregularities from reacting at the bolster and into the vehicle.

The stabilized railway freight car truck side frames are longitudinally rigid due to the limited longitudinal space between the transom and the side frames. The longitudinally rigid side frames are connected to the wheelsets by rotating lugs, adapters and elastomeric steering pads. The elastomeric stiffness of the steering pads provides movement to align the wheelsets to the railway track.

It is an object of the present invention to provide a railway freight car truck having improved stability and resistance to misalignment with the track.

SUMMARY OF THE INVENTION

A stabilized railway freight car truck of the three piece design is comprised of two laterally spaced side frames and a laterally extending bolster. A transom extends into an opening in each side frame. The ends of the transom are pivotally supported on transom hearings, which are supported on the lower portion of the center openings of the side frames. The spring suspension is supported on the transom, which in turn supports the holster.

For stable performance of the railway freight car truck, it is desirable to utilize friction damping in the form of friction shoes between the bolster and the side frame. There is a bolster low friction insert between friction shoes and bolster, as well as a space on either side of the friction shoes to accommodate lateral movement of the friction shoes without transmitting the lateral movement to the bolster.

The damping is derived from friction shoes with a pivotal friction face in the torr of a friction shoe insert that allows the friction force to react radially or pivotal. The damping contact surfaces are the side frame column wear plates and the friction shoe inserts. Preferably both the column wear plate and friction shoe insert are made of hardened material to limit wear. The friction shoe insert is positioned on a low friction insert recessed in the friction shoe face. The friction shoe insert has a radial space around it in the recess of the friction shoe face. The friction shoe insert can move pivotal and radially in the recess until it contacts the friction shoe recess wall. The friction shoe insert once in contact with the recess wall moves at the higher friction between the column wear plates and the friction shoe inserts, resulting in low friction force at initiation and higher friction force once engaged by movement of the suspension. The friction shoe insert also rotates against the column wear plate at low friction.

It is also desirable to have translation and warp constraint between the two side frames. The rotating connections of the transom to the side flumes and the side frames to the wheelsets mitigate track input from destabilizing truck performance. The translation or warping of the two side frames is eliminated by utilizing plain bearings between the transom bearing and rigid transom, and plain bearings are used between the side frame to the rotating lugs to eliminate gaps. The rotating lugs retain the elastomeric steering pads and bearing adapters. The rotating lugs keep the steering pads and bearing adapters aligned to the bearings and wheelsets due to the pivotal connection to the side frames.

It is also desirable to provide steering by translation at the elastomeric steering pad to control the wheelsets alignment to the railway track. The steering pad elastomer stiffness is sufficient to align the wheelset to the railway track in curves and straight track.

DETAILED DESCRIPTION OF THE INVENTION

Figure 1:
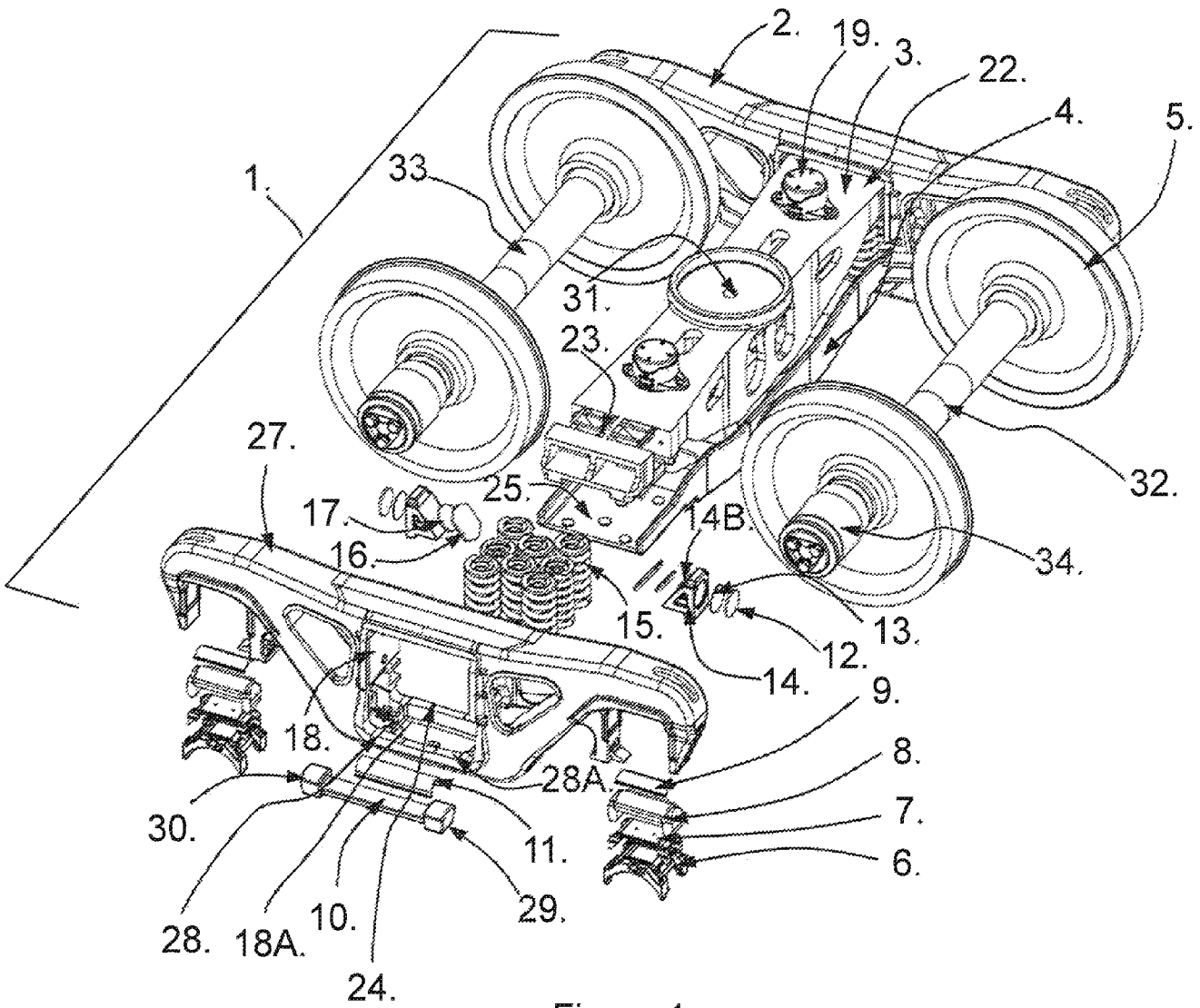
FIG. 1 is a perspective view of the truck assembly of a first embodiment of a stabilized railway car truck with components shown in a separated fashion in accordance with the present invention.

Referring now to FIG. 1, a stabilized railway truck 1 is seen to be comprised of two laterally spaced side frames 2 and 27, between which bolster 3 extends. Bolster 3 is seen to include bolster ends 22 and 23, each of which extends through a side frame opening 24. One end of bolster 3 and one end of transom 4 will be described. As the identical opposite end is not completely shown in FIG. 1. Transom 4 extends laterally under bolster 3. Transom end 25 supports a spring group 15. Spring group 15, is seen to support bolster end 23. Transom end 25 is supported on transom bearing 10, which transom bearing 10 is supported on a sideframe support surface 28A. The radial clearance between transom end 25 and transom bearing 10 is filled by elongated transom support bearing 11. The transom hearing ends 29 and 30 are supported adjacent side frame lower support 28. Each of side frames 2 and 27 and bolster 3 are usually a cast steel unitary structure. Transom 4 can be cast of ductile iron or steel. It is possible for transom 4 to be fabricated of steel, but a cast ductile iron transom is preferred due to the weight savings.

Bolster 3 is seen to include on its upper surface a bolster center plate 31, and a pair of laterally spaced side bearings 19. Each bolster end includes a pair of sloped surfaces 23A and 23B. Each bolster end slope surface forms a friction shoe pocket with sideframe.

Axles 32 and 33 extend laterally between side frames 2 and 27. Railway wheels 5 are press fit on the ends of axles 32 and 33. The ends of axles 32 and 33 are received in roller 245 bearings 34. Roller bearing 34 supports bearing adapter 6.

Bearing adapter 6 supports elastomeric steering pad 7. Steering pad 7 supports rotating lug 8. Rotating lug 8 is pivotally supported at the pedestal jaw end of side frames 27 and 2. Elongated support bearing 9 is placed between the pedestal jaw end of side frames 2 and 27 and the rotating lug 8.

Figure 2:
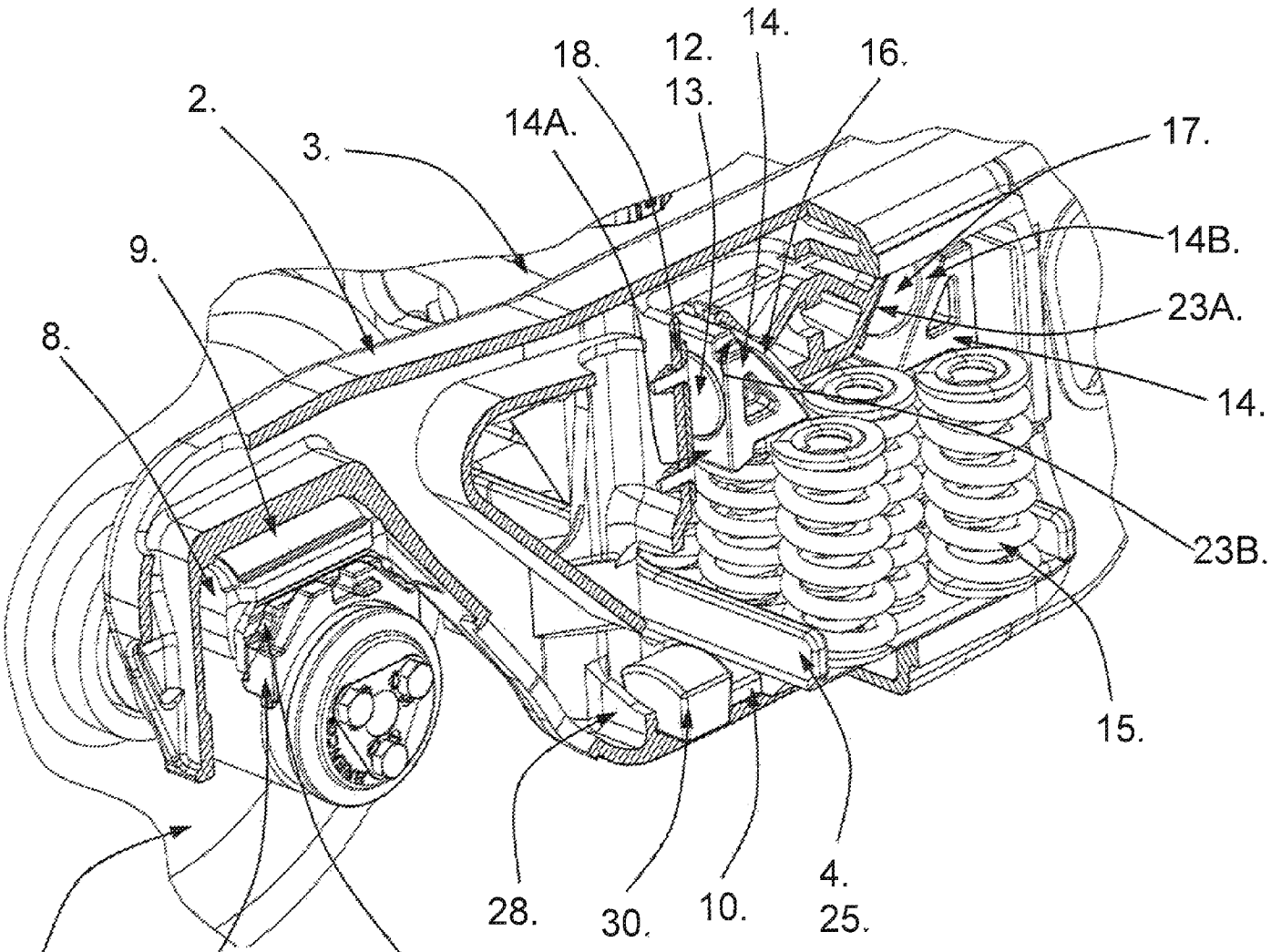
FIG. 2 is a partial detailed cut away view of the truck assembly of a first embodiment of a stabilized railway car truck in accordance with the present invention.

Referring now to FIG. 2, a partial detailed cut away view of the truck assembly 1 is shown along with detailed partial views of bolster 3 and side frame 2 in general cross section. Transom 4 extends laterally between side frames 2 and 27. Transom end 25 is supported on transom bearing 10. Transom bearing end 30 is supported and longitudinally constrained by side frame lower support 28. Friction shoe 14 engages bolster 2 via a low friction insert retainer 16 and a low friction insert 17 fitted on sloped face 14B of friction shoe 14. Friction shoe 14 can move laterally across low friction insert 17. Friction shoe 14 vertical face 14A also has a low friction insert 13 and friction shoe insert 12 that engages column wear plate 18 attached to vertical column 18A of side frame 2.

Figure 3A:
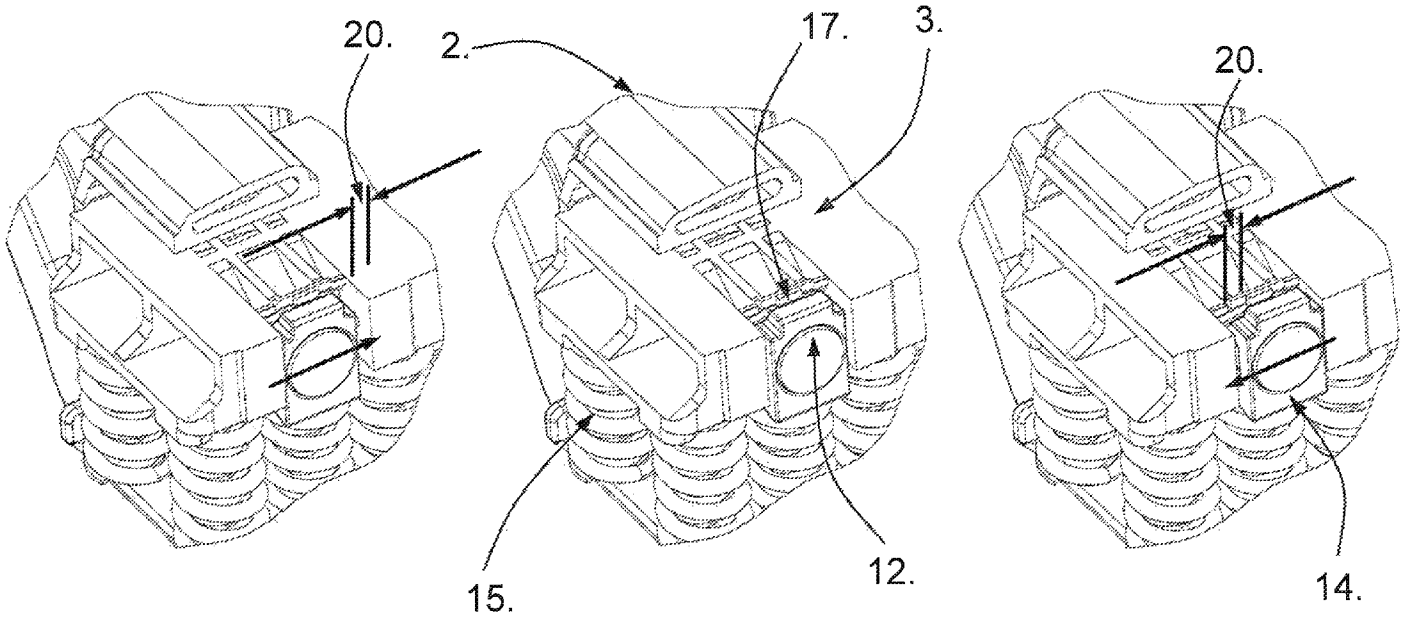
FIG. 3A is a partial view of a bolster and friction shoe of a first embodiment of a stabilized railway car truck in accordance with the present invention.

Referring now to FIG. 3A, presenting a partial view of bolster 3 and friction shoe 14. Bolster 3 is typically a cast steel unitary device, with internal ribs and supports to provide the strength necessary for a structural component of a stabilized railway freight car truck 1 while providing a generally lower weight structure. Bolster 3 has space 20 on both sides of friction shoe 14. The space 20 allows lateral movement of friction shoe 14 without transmitting the movement to the bolster 3. Lateral movement is accomplished due to the low friction insert 17 on friction shoe 14 decoupling the friction shoe force in direction of travel.

Figure 3B:
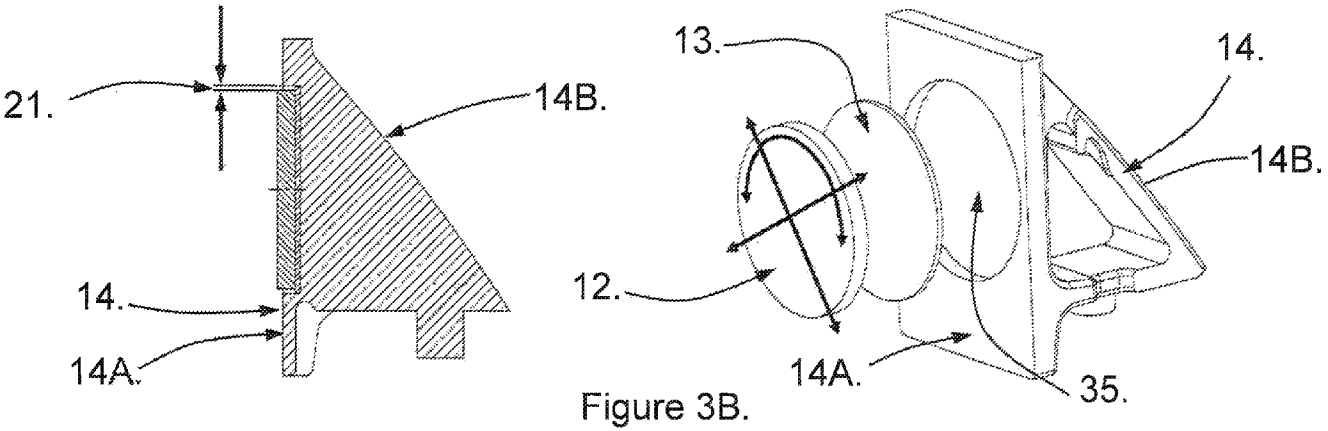
FIG. 3B is a section view and a perspective view of the friction shoe of a first embodiment of a stabilized railway car truck in accordance with the present invention.

Referring now to FIG. 1 and FIG. 3B, presenting a section view and a perspective view of friction shoe 14. Friction shoe vertical face 14A has a recess 35 for the friction shoe low friction insert 13 and the friction shoe high friction insert 12. The high friction insert 12 extends outwardly beyond the surface of friction shoe front face 14A. Friction shoe insert 12 has radial space 21 in recess 35 to move or rotate on and in contact with the low friction insert 13. Once movement of the friction shoe insert 12 exceeds the radial space 21, meeting the friction shoe vertical face 14A recess 35 wall, the low friction created by the friction shoe low friction insert 13 changes to the high friction between the high friction insert 12 and side frame column wear plate 18. Friction shoe sloped face 14B received bolster low friction insert retainer 16 which iN turn receives bolster low friction insert 17. Bolster low friction insert 17 is located between bolster sloped face 23A and sloped face 14B of friction shoe 14.

Figure 4:
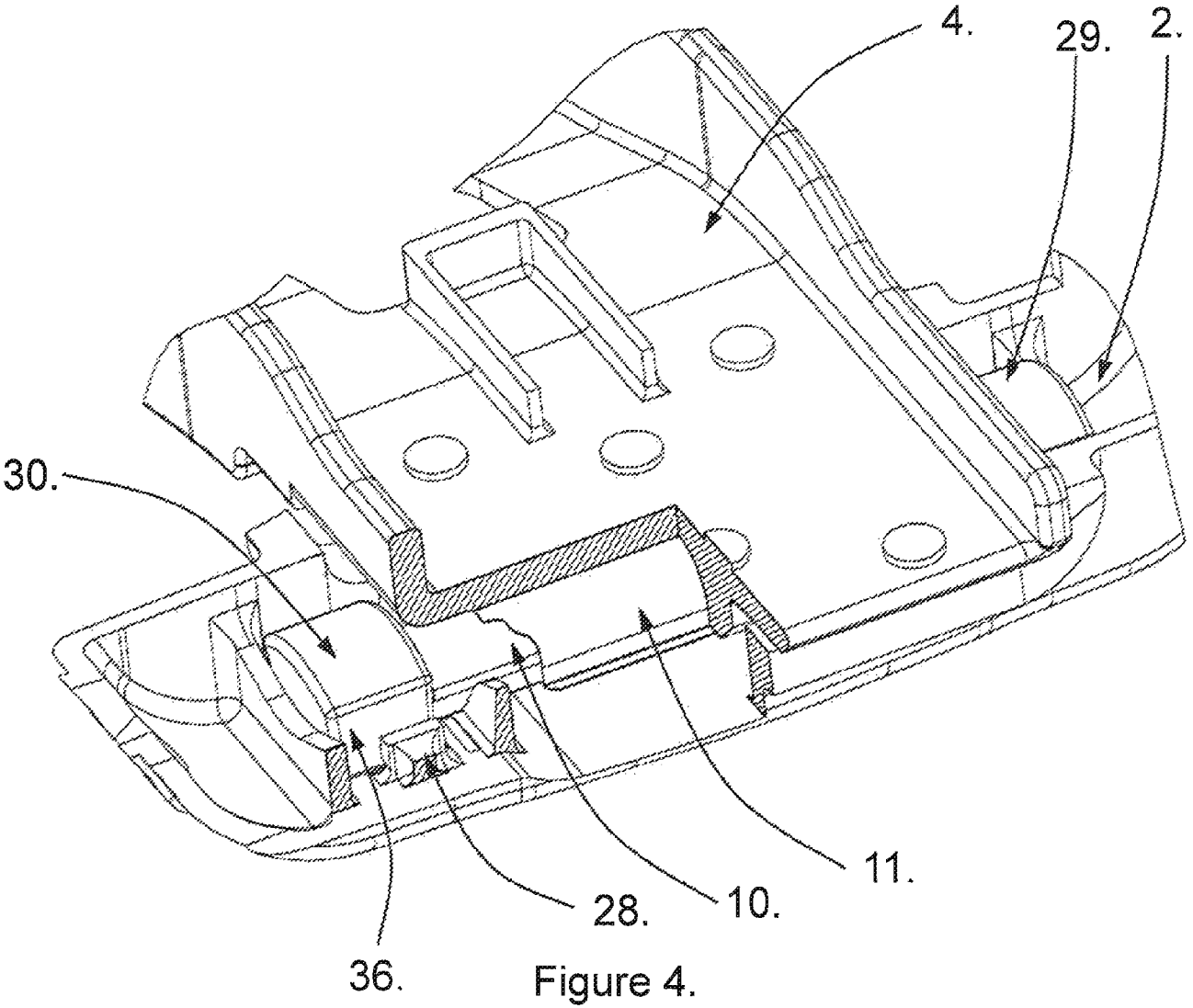
FIG. 4 is a perspective view of the transom relationship to the side frame of a first embodiment of a stabilized railway car truck in accordance with the present invention.

Referring now to FIG. 4, presenting a perspective view of the relationship of transom 4 to side frame 2. Side frame 2 pivotally supports transom 4 on transom bearing 10. Transom bearing ends 29 and 30 have tapered walls 36 that engage in the side frame lower support 28 walls. The radial space between the transom 4 and transom bearing 10 is filled with transom support bearing 11. This makes the connection between the side frame 2 and transom 4 vertically supported, but able to pivotally rotate.

Figure 5:
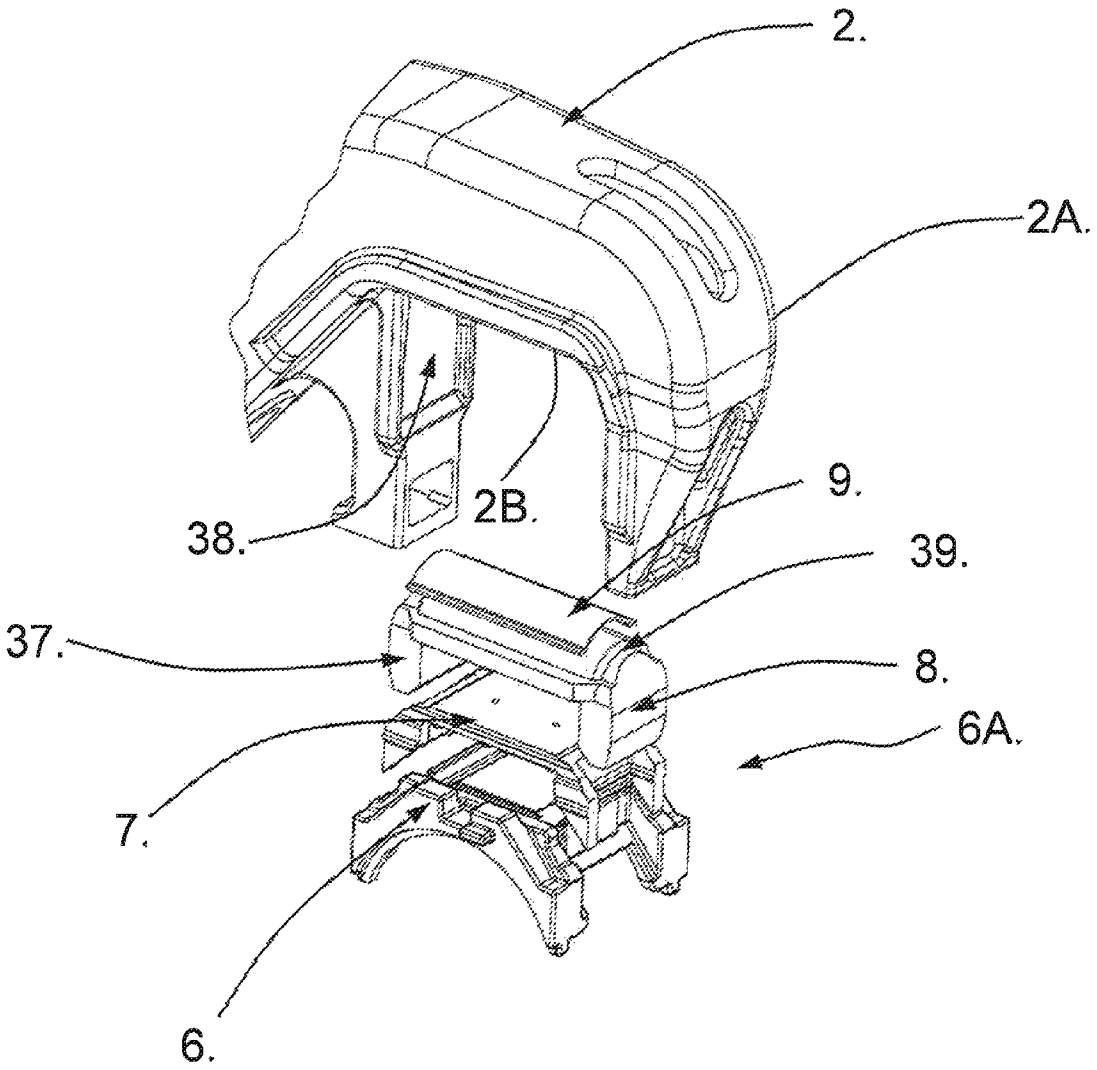
FIG. 5 is a perspective partial view of the side frame relationship to the adapter of a first embodiment of a stabilized railway car truck in accordance with the present invention.

Referring now to FIG. 5, a perspective partial view of the relationship of side frame 2 to the bearing adapter assembly 6A. Side frame 2 pedestals 2A have conical roofs 2B to receive support bearings 9 and rotating lugs 8. Rotating lug 8 allows pivotal movement between side frame 2 and bearing adapter 6. Rotation of the rotating lug ends 37 is restricted in the lug recess 38 of side frame 2. Rotating lugs 8 also support elastomeric steering pad 7. Rotating lug 8 is constrained from longitudinal movement by translation stop 39 contact against the end of conical roof 2B of the side frame pedestal 2A. Steering is accomplished by the wheelset longitudinal force on bearing adapter 6 compressing the elastomeric steering pad 7 against the rotating lug ends 37.

Figure 6:
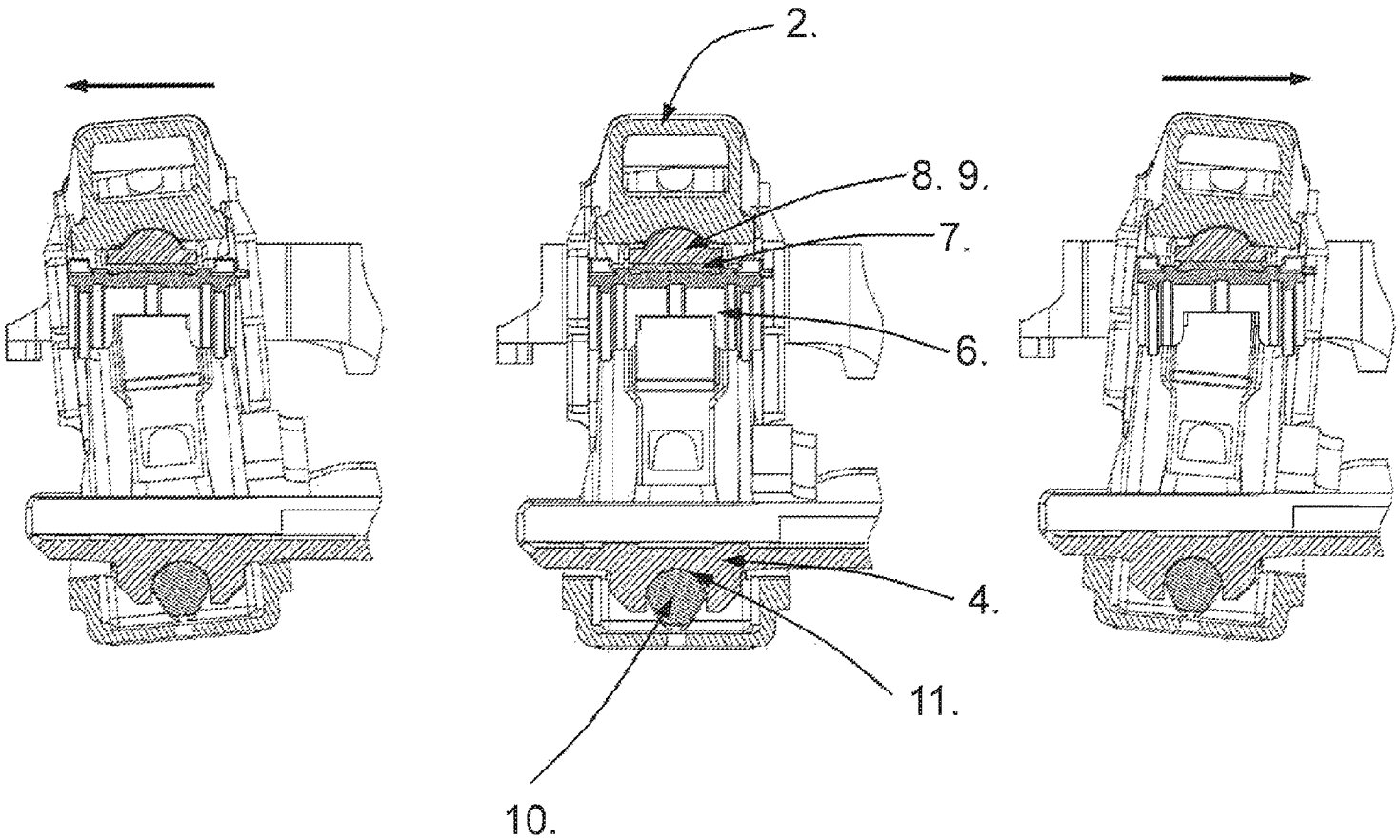
FIG. 6 is a section view of the pivotal relationship of the transom and side frame of the first embodiment of a stabilized railway car truck in accordance with the present invention.

Referring now to FIG. 6, presenting a sectional view of the pivotal relationship of transom 4 and side frame 2. The wheelsets 5 support bearing adapter 6, steering pad 7, rotating lug 8, and support hearing 9 that supports side frame 2. Side frame 2 in turn supports transom bearing 10, support bearing 11, and transom 4. The normal vertical load aligns transom bearing 10 directly below the rotating lug 8 pivot. When a lateral movement is imparted at the bearing adapter 6, the movement reacts through side frame 2 to transom 4. The lateral movement mitigates the railway track lateral displacement irregularities from transom 4.

What is claimed is:

1. A railway freight car truck comprising:

a pair of parallel sideframes, a transom extending laterally between the sideframes, a bolster extending laterally between the sideframes, each sideframe including a support surface, a transom bearing supported on each sideframe support surface, each sideframe also including a lower support which is adjacent an end of the transom bearing, a transom support bearing supported on each transom bearing, and an end of the transom supported on each transom support bearing, a spring group supported by an end of the transom, a bolster end supported by the spring group, a pair of axles extending laterally between the sideframes, each sideframe having a pedestal formed at an end of the sideframe, an axle bearing fitted to an end of each axle,
a bearing adapter fitted on each axle bearing,
a steering pad fitted on each bearing adapter,
a rotating lug fitted on each steering pad,
and an axle support bearing fitted on each rotating lug,
the axle support bearing supporting the axle bearing, wherein
each sideframe includes two vertical columns,
and a wearplate affixed to each sideframe vertical column,
and each bolster end includes two sloped surfaces,
each bolster sloped surface and each sideframe vertical column forming a friction shoe pocket therebetween,
a friction shoe in each friction shoe pocket,
the friction shoe including a vertical face adjacent one of the sideframe wearplates and a sloped face adjacent one of the bolster sloped surfaces,
a recess in each friction shoe vertical face,
a low friction insert located in the friction shoe vertical face recess,
and a high friction insert located adjacent the low friction insert such that the high friction insert extends outwardly from the recess beyond the vertical face of the friction shoe to engage the sideframe column wear plate.

2. The railway freight car truck of claim 1 wherein
each sideframe includes two vertical columns,
and a wearplate is affixed to each sideframe vertical column,
and each bolster end includes two sloped surfaces,
each bolster sloped surface and each sideframe vertical column forming a friction shoe pocket therebetween,
a friction shoe in each friction shoe pocket,
the friction shoe including a partial face adjacent one of the sideframe wear plates and a sloped face adjacent one of the bolster sloped surfaces,
a low friction insert located on the friction shoe sloped face and a high friction insert located adjacent the low friction insert each that the length friction insert extends outwardly beyond the sloped face of the friction shoe to engage the bolster sloped surface.

3. The railway freight car truck of claim 1 further comprising
a low friction insert located on the friction shoe sloped face and a high friction insert located adjacent the low friction insert such that the high friction insert extends outwardly beyond the sloped face of the friction shoe and engages the bolster sloped surface.

4. The railway freight car truck of claim 1
wherein the recess in the friction shoe vertical face has a larger area than the low friction insert located in the recess in the friction shoe vertical face thereby allowing the low friction insert to move radially in the recess until contacting a radial wall forming the recess in the friction shoe vertical wall.

5. The railway freight car truck of claim 4,
wherein upon the low friction insert contacting the radial wall forming the recess in the vertical face of the friction shoe, the high friction insert will promote a higher friction resistance to movement of the bolster against the friction shoe and in relation to the sideframe.

6. A railway freight car truck comprising:
a pair of parallel sideframes,
a transom extending laterally between the sideframes,
a bolster extending laterally between the sideframes,
each sideframe including a support surface,
a transom bearing supported on each sideframe support surface,
each sideframe also including a lower support which is adjacent an end of the transom bearing,
a transom support bearing supported on each transom bearing,
and an end of the transom supported on each transom support bearing,
a spring group supported by an end of the transom,
a bolster end supported by the spring group,
a pair of axles extending laterally between the sideframes,
each sideframe having a pedestal formed at an end of the sideframe,
an axle bearing fitted to an end of each axle,
a bearing adapter fitted on each axle bearing
a steering pad fitted on each bearing adapter,
a rotating lug fitted on each steering pad,
and an axle support bearing fitted on each rotating lug,
the axle support bearing supporting the axle bearing,
wherein each sideframe includes two vertical columns, and
a wearplate affixed to each sideframe vertical column,
and each bolster end includes two sloped surfaces,
each bolster sloped surface and each sideframe vertical column forming a friction shoe pocket therebetween,
a friction shoe in each friction shoe pocket,
the friction shoe including a vertical base adjacent one of the sideframe wearplates and a sloped base adjacent one of the bolster sloped surfaces,
a recess in each friction shoe vertical face,
a low friction insert located in the friction shoe vertical face recess,
and a high friction insert located adjacent the low friction insert such that the high friction insert extends outwardly from the recess beyond the vertical face of the friction shoe to engage the sideframe column wear plate.

7. The railway freight car truck of claim 6 wherein
each sideframe includes two vertical column,
and a wearplate is affixed to each sideframe vertical columns,
and each bolster end includes two sloped surfaces,
each bolster sloped surface and each sideframe vertical column forming a friction shoe pocket therebetween,
a friction shoe in each friction shoe pocket,
the friction shoe including a vertical face adjacent one of the sideframe wearplates and a sloped face adjacent one of the bolster sloped surfaces,
a low friction insert located on the friction shoe sloped face and a high friction insert located adjacent the low friction insert such that the high friction insert extends outwardly beyond the sloped face of the friction shoe to engage the bolster sloped surface.

8. The railway freight car truck of claim 7 further comprising
a low friction insert located on the friction shoe sloped face and a high friction insert located adjacent the low friction insert such that the high friction insert extends outwardly beyond the sloped face of the friction shoes and engages the bolster sloped surface.

9. The railway freight car truck of claim 7
wherein the recess in the friction shoe vertical face has a larger area than the low friction insert located in the recess in the friction shoe vertical face thereby allowing the low friction insert to move radially in the recess until contacting a radial wall forming the recess in the friction shoe vertical wall.

10. The railway fright car truck of claim 9,
wherein upon the low friction insert contacting the radial wall forming the recess in the vertical face of the friction shoe, the high friction insert will promote a higher friction resistance to movement of the bolster against the friction shoe and in relation to the sideframe.

* * * * *